United States Patent [19]

Smeltzer et al.

[11] Patent Number: 4,762,647

[45] Date of Patent: Aug. 9, 1988

[54] ION EXCHANGE RESIN VOLUME REDUCTION

[75] Inventors: Eugene E. Smeltzer, Salem Township, Westmoreland County; Michael C. Skriba, Plum Boro, both of Pa.; Keith K. McDaniel, Ellicott City, Md.

[73] Assignee: Westinghouse Electric Corp., Pittsburgh, Pa.

[21] Appl. No.: 905,895

[22] Filed: Sep. 10, 1986

Related U.S. Application Data

[63] Continuation-in-part of Ser. No. 744,089, Jun. 12, 1985, abandoned.

[51] Int. Cl.[4] ..... G21F 9/08; G21F 9/14

[52] U.S. Cl. ..... 252/632; 100/38; 100/41; 100/92; 100/93 R; 100/93 P; 252/628; 252/629; 252/631; 264/0.5; 264/176.1; 264/177.11

[58] Field of Search ..... 252/631, 632, 629, 628, 252/626; 264/0.5, 125, 572, 176.1, 177.11; 100/92, 93 R, 93 P, 903, 38, 41

[56] References Cited

U.S. PATENT DOCUMENTS

| | | | |
|---|---|---|---|
| 3,679,595 | 7/1972 | Döllgast | 252/632 |
| 4,252,667 | 2/1981 | Stegmaier et al. | 252/628 |
| 4,268,409 | 5/1981 | Ga et al. | 252/632 |
| 4,290,907 | 9/1981 | Horiuchi et al. | 252/632 |
| 4,452,733 | 6/1984 | Horiuchi et al. | 252/632 |
| 4,460,500 | 7/1984 | Hultgren | 252/629 |
| 4,526,712 | 7/1985 | Hirano et al. | 252/632 |
| 4,559,170 | 12/1985 | Gay et al. | 252/632 |
| 4,636,335 | 1/1987 | Kawamura et al. | 252/629 |

*Primary Examiner*—Stephen J. Lechert, Jr.
*Assistant Examiner*—Howard J. Locker
*Attorney, Agent, or Firm*—Joel R. Petrow

[57] ABSTRACT

A process is described for reducing the volume of spent ion exchange resins containing radioactive contaminants, and a filter aid having groups reactive with the functional groups of the resins. Spent ion exchange resin and the filter aid are dewatered, then subject to a pressure of about 2000 psi in conjunction with 250° C. heat to reduce the volume occupied by the resin by up to a factor of 5 and impart rewet stability.

16 Claims, No Drawings

ION EXCHANGE RESIN VOLUME REDUCTION

RELATED APPLICATIONS

This application is a continuation-in-part of U.S. application Ser. No. 06/744,089 filed on June 12, 1985 (now abandoned) by the same inventors and assigned to the same assignee.

BACKGROUND OF THE INVENTION

This invention relates to a method for the management of low level radioactive nuclear power plant wastes, in particular the compaction and disposal of beadand powdered ion exchange resins mixed with a filter aid.

One of the common low-level radioactive waste products produced by nuclear power plants is ion exchange resins. These resins are used to process water that circulates through the core of the nuclear reactor or steam generator. While ion exchange resin remove ion contaminants from plant coolant water, the filter aid removes undissolved particulates. A filter aid is any material such as cellulose layered on a filter cartridge along with the powdered resin to remove solid material. The resin and filter aid do not chemically react at the water temperature encountered in processing water from the nuclear plant, usually below about 60° C. Elevated temperatures, those much above about 60° C., are not usual and water of 100° C. or greater is not encountered because the processing system is not pressurized.

Bead type resins are usually used in pressurized water reactor type plants to remove ions, but are not mixed with a filter aid since filtration is not intended. Boiling water reactor type plants use the powered resin with cellulose filter aid for the dual purpose of ion exchange and filtration. The resins, and cellulose when spent retain residual radioactivity and have to be disposed of in a safe manner which usually requires burial in a land fill.

The current practice is to encapsulate the resin in a matrix of cement or polymer to ensure adequate mechanical integrity as well as preventing leaching of radioactive substances from the resin by ground water. The disadvantage of this method is that it increases the volume of material that needs to be disposed. The price of disposal is closely related to the volume of material. Another method recently developed uses high integrity containers to hold the resins and cellulose without the addition of cement. The containers are designed to maintain boundary integrity for several hundred years. But again, the cost of transporting and burying the wastes is based upon their volume. Significant cost savings can be realized if the volumes are reduced.

It is the object of this invention, therefore, to describe a method whereby the volume of ion exchange resins mixed with filter aid can be significantly reduced, and it is a further object of this invention to describe a method wherein the volume reduced resins display the ability to resist dissolution of the radioactive material in the presence of water.

SUMMARY OF THE INVENTION

The above-described resins are particulates having a void factor of approximately 30–40%. By applying the proper mechanical force or pressure the particles can be forced closer together, reducing the void fraction and thereby the total volume. At an elevated temperature cross-link bonds in the resin are broken and the resin does not spring back. It has been found that the volume of a mixture of 30 to 60 weight percent (w%) ion exchange resin and 40 to 70 w% cellulose filter aid can be reduced significantly by removing the water from the mixture, raising the mixture to an elevated temperature of about 230° C. and compacting the heated resin with a force of at least 2000 psi. A further advantage is realized in that the resin sinters to form a monolith that is physically stable in water.

DESCRIPTION OF THE PREFERRED EMBODIMENT

A mixture of depleted resins of either a bead or powdered form and cellulose filter aid containing radioactive residue are drained of excess liquid. The mixture may be simply a drained slurry or can be completely dried. The mixture to be processed may be of a single type, such as an anion or cation resin or it may be a mixture of these different types. Acidic reactive groups remove positively charged ions/cations, from solution making it a cation resins. A commonly used acidic reactive group on ion ecxchange resin is the carboxyl radical,

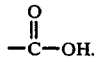

Another frequently used acidic reactive group is the sulfonic radical,

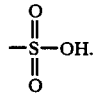

As the solution is passed through the cation exchanger, cations replace the H on the resin. A resin having basic reactive groups such as hydroxyl, —OH, remove anions which are negatively charged in solution from the solution by exchange with the OH group. Other basic reactive groups such as primary amine, $RNH_2$; secondary amine $R_2NH$; tertiary amine, $R_3N$; or quaternary ammonium, $R_4N+$, may also be utilized to create an anion resin.

Filter aids employed in processing water from a nuclear power plant comprise a wide range of natural and man-made materials, having in common the ability to trap undissolved particles in the water. The filter aids to which the process of the present invention is applicable are reactive with the acidic or basic groups on the ion-exchange resin.

The commonly used filter aid with powdered resins is plant cellulose,

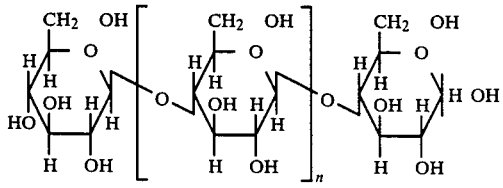

Other polymeric materials based on the cellulose chain but having other groups substituted for the H and OH groups are acceptable substitutes.

In the preferred embodiment the resin contains cellulose filter aids that were used in processing water from the nuclear plant in the amount from about 40 w% to about 70 w% of the mixture. The process of volume reduction is relatively insensitive to the presence of some amount of crud that may result from ion exchange processing of the water. In short, the mixture may be unused or it may be exhausted resin and filter aid that contains extraneous material. Should the resin not contain cellulose filter aid, it would need to be added. Further, bead type resin would benefit from size reduction of the beads.

Some benefit in volume reduction is obtained simply by compression resin with or without filter aid at ambient temperatures. The compaction may be in a single or multiple compression stages with a force ranging from 2000 psi to about 6500 psi. While pressure is being applied the resin occupies a compacted reduced volume. After the pressure is removed the resin then occupies a generally larger released volume. For compactions done at ambient temperatures volume reduction factors (that is, original volume divided by reduced volume) of the released resin ranges from approximately 1.2 to approximately 3.

It has been found that an increase in the volume reduction factor can be obtained if the resins are dewatered and are heated during the compression. By applying heat, particles can be deformed further fo a given pressure causing them to come closer together, thus reducing the void percentage and thereby the total volume even more than by the simple application of high mechanical pressures. At a temperature of approximately 250° C., for instance, the released volume reduction factor increases from approximately 1.75 to greater than 5.

Any method of applying a compressive force to the ion exchange resin may be used. One method, that used in obtaining the experimental results, is the application of the compressive force by a ram press, such as a hydraulically driven piston inside a cylinder.

A second method, the method deemed to be preferred in commercial applications, is the employment of an extrusin press. This method would allow the continuous processing of ion exchange resin by feeding the dewatered resin into one end of the extruder, heating, compressing, and removing the sintered material from the other end of the extruder.

A third method of heating and compressing the resin is to use heated inert gas to apply isostatic pressure to the resin. The resin is volume reduced by the pressure and heat contained in a gas such as argon.

The benefit realized for powdered resins mixed with cellulose filter aid representing 40 to 70 w% of the mixture which is heated to an elevated temperature of approximately 230° C. during the compression and held at temperature and pressure for at least 20 minutes, is that in addition to increasing the volume reduction factor for powdered resins, the combination greatly increases the resins' stability in the presence of water by making it rewet stable. The rewet stable resin forms a monolith that is physically stable in the presence of water and will not fall apart. This gives a waste form that is more desirable for burial since any intrusion of water will not destroy the stability or integrity of the waste form and cause leaching of the radioactive material into the water. A similar benefit is expected for bead resins mixed with filter aid.

EXPERIMENTAL RESULTS

Several tests were performed on the process in a piston and cylinder apparatus using a calibrated testing machine to measure the force applied and the resultant deflection. The volume reduction factor was then calculated from the original volume of resin and the amount of deflection either under pressure or after release for various applied pressures. A temperature controlled clam shell type oven was also used around the piston cylinder assembly to allow heat to be applied during the compression. Both the piston and cylinder apparatus and the oven are of designs commonly known to those skilled in the art and the particulars are not critical to the process.

Table I summarizes the results of the compaction process performed upon wet vacuum dewatered bead resin at ambient temperature. Tests No. 1, 2 and 3 were done with single compression and resulted in released volume reduction factors of up to 1.46. Test No. 4 compaction consisted of multiple compressions of the same sample of bead resin. In this case the released volume reduction factor achieved was 1.77.

TABLE 1

| | Wet, Vacuum Dewatered Bead Resin | | | | |
|---|---|---|---|---|---|
| Test No. | Compaction Force (psi) | Volume Reduction Factor Compacted | Volume Reduction Factor Released | Temp. (°C.) | Rewet Stable |
| 1 | 3180 | 1.95 | 1.32 | 21 | No |
| 2 | 4650 | 2.05 | 1.36 | 21 | No |
| 3 | 5030 | 2.11 | 1.46 | 21 | No |
| 4 | 4580 | 2.13 | 1.54 | 21 | |
| | 4490 | 2.21 | 1.63 | 21 | |
| | 4330 | 2.25 | 1.69 | 21 | |
| | 4460 | 2.29 | 1.73 | 21 | |
| | 4360 | 2.29 | 1.75 | 21 | |
| | 6520 | 2.41 | 1.77 | 21 | |
| | 6270 | 2.45 | 1.77 | 21 | No |

Table 2 describes the results of compaction at ambient and elevated temperature on dry bead resin. Test 1 was a single compression, whereas Tests 2 and 3 were multiple compressions. In this series of tests, the resin samples were heated in tests 2 and 3. Heating to 125° C. achieved a released volume reduction factor of 1.49, while heating to 250° C. obtained a released volume reduction factor of 1.75. From this series of tests it is expected that worthwhile volume reductions can be obtained from minimum temperatures from about 100° C. and minimum pressures from about 2000 psi.

TABLE 2

| | Dry Bead Resin | | | | |
|---|---|---|---|---|---|
| Test No. | Compaction Force (psi) | Volume Reduction Factor Compacted | Volume Reduction Factor Released | Temp. (°C.) | Rewet Stable |
| 1 | 5030 | 1.35 | 1.19 | 21 | No |
| 2 | 4420 | 1.29 | — | 125 | |
| | 4620 | 1.32 | — | 125 | |
| | 4810 | 1.34 | — | 125 | |
| | 4420 | 1.47 | — | 125 | |
| | 4780 | 1.51 | — | 125 | |
| | 4810 | 1.53 | 1.49 | 125 | No |
| 3 | 4420 | — | — | 250 | |
| | 4490 | — | — | 250 | |
| | 4420 | — | — | 250 | |
| | 4360 | — | 1.75 | 250 | No |

Table 3 describes the results of compaction at ambient temperature upon wet vacuum dewatered powdered resins with a filter aid. A released volume reduction factor of 2.16 was obtained with multiple compressions.

TABLE 3

| Wet, Vacuum Dewatered Powdered Resin, with Filter-Aid | | | | | |
|---|---|---|---|---|---|
| Test No. | Compaction Force (psi) | Volume Reduction Factor Compacted | Volume Reduction Factor Released | Temp. (°C.) | Rewet Stable |
| 1 | 4650 | 2.51 | 1.20 | 21 | No |
| 2 | 4650 | 2.63 | 1.67 | 21 | No |
| 3 | 5030 | 2.38 | 1.50 | 21 | No |
| 4 | 4490 | 2.60 | 1.83 | 21 | |
| | 4330 | 2.62 | 1.86 | 21 | |
| | 6430 | 2.89 | 2.04 | 21 | |
| | 6490 | 3.12 | 2.07 | 21 | |
| | 6520 | 3.29 | 2.16 | 21 | |
| | 6430 | 3.50 | 2.16 | 21 | |
| | 6300 | 3.54 | 2.16 | 21 | No |

Finally, compaction of dry powdered resin with a filter aid was tested using both single and multiple compressions and heating the powdered resin to either 200 or 250° C. before applying the compression force. A released volume reduction factor as high as 5.36 was obtained and, in addition, those samples heated to 250° C. were rewet stable upon release.

TABLE 4

| Dry Powdered Resin, with Filter-Aid | | | | | |
|---|---|---|---|---|---|
| Test No. | Compaction Force (psi) | Volume Reduction Factor Compacted | Volume Reduction Factor Released | Temp. (°C.) | Rewet Stable |
| 1 | 4520 | 3.38 | 2.98 | 21 | No |
| 2 | 4650 | 3.81 | 3.30 | 21 | |
| | 4360 | 3.91 | — | 21 | |
| | 5480 | 4.14 | 3.45 | 21 | |
| | 4360 | 4.14 | 3.45 | 21 | No |
| 3 | 4620 | — | 4.14 | 200 | No |
| 4 | 4300 | — | 4.82 | 250 | Yes |
| 5 | 4460 | — | 4.89 | 250 | Yes |
| 6 | 6330 | — | 5.36 | 250 | Yes |
| 7 | 4420 | — | 4.76 | 230 | Yes |

In summary, an advantage is gained by multiple compression of the resin leading to increased released volume reduction factors. The use of 230° C. temperature during the compression of the powdered resins mixed with filter aid (cellulose) yielded a material that was rewet stable. It is expected that this property would also be obtainable for bead-type resins where the bead type resin is first size reduce and mixed with recommended amount of cellulose.

It should be kept in mind that this process can be carried out in any type of equipment that can provide the desired compaction forces and the desired temperature. For example, another system that may be used is an isostatic press that utilizes an inert gas, such as argon, at elevated temperatures and pressures to compress the resin within a chamber, or the resin may be passed through an extrusion press for heating and compaction.

We claim:

1. A method for reducing the volume of radioactive material comprising between about 30 w% to about 60 w% spent ion exchange resin and between about 40 w% to about 70 w% of a filter aid, said filter aid reactive therewith at an elevated temperature said method comprising:

dewatering the spent ion exchange resin, heating the dewatered resin to the elevated temperature, and compressing the dewatered resin heated to the elevated temperature with a force of at least about 2000 psi for a period of time sufficient to cause the resin to sinter and become rewet stable.

2. The method of claim 1 wherein said ion exchange resin contains acidic reactive groups.

3. The method of claim 2 wherein said acidic reactive groups are carboxylic acid.

4. The method of claim 2 wherein said acidic groups are sulfonic acid.

5. The method of claim 1 wherein said ion exchange resin contains basic groups.

6. The method of claim 5 wherein said basic group is selected from the group consisting of primary amine, secondary amine, tertiary amine, quaternary ammonium and mixtures thereof.

7. The method of claim 5 wherein said basic group is hydroxyl.

8. The method of claim 1 wherein said filter aid contains hydroxyl groups.

9. The method of claim 1 wherein said filter aid is cellulose based.

10. A method for reducing the volume of radioactive material comprising substantially between about 30 w% to about 60 w% spent ion exchange resin and between about 40 w% to about 70 w% cellulose filter aid, said method comprising:

dewatering the spent ion exchange resin, heating the dewatered resin to at least about 230° C., and compressing the dewatered resin heated to at least about 230° C. with a force of at least about 2000 psi for a period of time sufficient to cause the resin to sinter and become rewet stable.

11. The method of claim 1 wherein said compressing is to at least about 4300 psi.

12. The method of claim 1 wherein said compressing is performed by a ram press.

13. The method of claim 1 wherein said compressing is performed by an extrusion press.

14. The method of claim 1 wherein said heating and compressing is performed by using heated inert gas to apply isostatic pressure to the resin.

15. The method of claim 10 wherein said heating and compressing are performed for a period of at least 20 minutes.

16. The method of claim 1 wherein said compressing is performed by a plurality of compression steps.

* * * * *